US008698401B2

(12) United States Patent
Kaufman et al.

(10) Patent No.: US 8,698,401 B2
(45) Date of Patent: Apr. 15, 2014

(54) MITIGATION OF PLASMA-INDUCTOR TERMINATION

(75) Inventors: Harold R. Kaufman, LaPorte, CO (US); James R. Kahn, Ft. Collins, CO (US)

(73) Assignee: Kaufman & Robinson, Inc., Ft. Collins, CO (US)

( * ) Notice: Subject to any disclaimer, the term of this patent is extended or adjusted under 35 U.S.C. 154(b) by 489 days.

(21) Appl. No.: 12/925,082

(22) Filed: Oct. 13, 2010

(65) Prior Publication Data

US 2011/0163674 A1 Jul. 7, 2011

Related U.S. Application Data

(60) Provisional application No. 61/335,302, filed on Jan. 5, 2010.

(51) Int. Cl.
*H05B 31/26* (2006.01)

(52) U.S. Cl.
USPC ..... 315/111.61; 315/111.21; 315/111.51

(58) Field of Classification Search
CPC ..... H05H 1/00; H05H 3/00; H05H 15/00; H05H 2001/00
USPC ..... 315/111.01–111.91
See application file for complete search history.

(56) References Cited

U.S. PATENT DOCUMENTS

| | | | | |
|---|---|---|---|---|
| 3,311,772 | A | 3/1967 | Speiser et al. | 313/63 |
| 3,958,883 | A | 5/1976 | Turner | 356/85 |
| 4,862,032 | A | 8/1989 | Kaufman et al. | 313/359.1 |
| 5,003,225 | A * | 3/1991 | Dandl | 315/111.41 |
| 5,198,718 | A | 3/1993 | Davis et al. | 313/359.1 |
| 5,274,306 | A | 12/1993 | Kaufman et al. | 315/111.41 |
| 5,304,282 | A * | 4/1994 | Flamm | 216/68 |
| 6,127,275 | A * | 10/2000 | Flamm | 438/710 |
| 6,777,699 | B1 * | 8/2004 | Miley et al. | 250/492.3 |
| 7,183,716 | B2 * | 2/2007 | Kanarov et al. | 315/111.51 |
| 7,309,961 | B2 * | 12/2007 | Park et al. | 315/111.51 |
| 7,557,362 | B2 | 7/2009 | Yevtukhov et al. | 250/423 R |
| 2008/0122367 | A1 * | 5/2008 | Vinogradov et al. | 315/111.21 |

OTHER PUBLICATIONS

Wykoff et al., 50-CM Linear Gridless Source,,pp. 81-88, Eigth Annual International Conference On Vacuum Web Coating, 1994.
Kaufman, et al., Focused ion beam designs for sputter deposition, J.Vac.Sci. Technol. 16(3) May/Jun. 1979, pp. 899-905.
Kaufman et al., Technology and applications of broad-beam ion sources used in sputtering, J.Vac.Sci. Technol. 21(3) Sep./Oct. 1982, pp. 725-736.
Zhurin, et al., Physics of closed drift thrusters, Plasma Sources Sci. Technol. 8 (1999), pp. R1-R20.
Kaufman et al., Ion Source Design for Industrial Applications, AIAA Journal. vol. 20, No. 6, Jun. 1982, pp. 745-760.

* cited by examiner

*Primary Examiner* — Douglas W Owens
*Assistant Examiner* — Henry Luong
(74) *Attorney, Agent, or Firm* — Dean P. Edmundson

(57) ABSTRACT

In accordance with one embodiment of the present invention, the dielectric discharge chamber of a generally axially symmetric ion source has a hollow cylindrical shape. One end of the discharge chamber is closed with a dielectric wall. The working gas is introduced through an aperture in the center of this wall. The ion-optics grids are at the other end of the discharge chamber, which is left open. The inductor is a helical coil of copper conductor that surrounds the cylindrical portion of the dielectric discharge chamber. The modification that produces uniformity about the axis of symmetry is a shorted turn of the helical-coil inductor at the end of the inductor closest to the ion-optics grids.

24 Claims, 5 Drawing Sheets

MITIGATION OF PLASMA-INDUCTOR TERMINATION

CROSS-REFERENCE TO RELATED APPLICATION

This application is based upon, and claims priority from, our Provisional Application No. 61/335,302, filed Jan. 5, 2010.

FIELD OF INVENTION

This invention relates generally to ion and plasma sources, and more particularly it pertains to those sources in which ions are generated with an inductively coupled radio-frequency discharge.

BACKGROUND ART

A plasma can be defined as an electrically conducting gas that satisfies quasi-neutrality. For singly charged ions, the type most often generated in ion and plasma sources, this means that the density of electrons and ions is approximately equal ($n_e \approx n_i$). An ion or plasma source typically has a discharge region in which ions are generated by the collisions of energetic electrons with molecules of the working gas, a region of ion acceleration, and a region through which the beam of energetic ions travels after it leaves the source. Beams from industrial ion or plasma sources are used for etching, deposition and property modification. These sources operate in vacuum chambers, which are continually pumped while the source is operating to maintain a background pressure of approximately $10^{-3}$ Torr (0.13 Pascals) or less for ion sources and up to several times that high for some plasma sources. Ion or plasma sources are also used for space propulsion, in which case the beam provides propulsion for a spacecraft and the background pressure is much less than $10^{-3}$ Torr.

Both gridded and gridless ion and plasma sources are used in industrial applications and space propulsion. For a gridless ion source, a quasi-neutral plasma extends from the discharge region, through the acceleration region, into the beam. (An exception exists for a short distance of the acceleration region of an anode-layer source.) There may also be some overlap of the ion generation, ion acceleration, and beam regions in a gridless source. Such sources have been called both ion and plasma sources. For consistency herein, they are called "plasma sources." In a gridless plasma source the acceleration can be electromagnetic—caused by the interaction of an electron current with a magnetic field, which establishes an electric field in a quasi-neutral plasma. The electron current that interacts with the magnetic field is supplied by a source of electrons at the exit of the source. This acceleration process is described in more detail in an article by Zhurin, et al., in *Plasma Sources Science & Technology*, Vol. 8 (1999), beginning on page R1.

The ion acceleration in a plasma source can also take place as the result of the expansion from a high plasma density to a low plasma density as it leaves the source. At the low background pressures assumed herein, the plasma potential and the density are related by the Boltzmann relation, $$n_e = n_{e,o}\exp(V_p/T_e), \tag{1}$$

where $n_{e,o}$ is the reference plasma density where the plasma potential is defined as zero, $V_p$ is the plasma potential at a density $n_e$, and $T_e$ is the electron temperature in electron-volts. From Equation (1), the decrease in plasma density as the plasma leaves the plasma source results in a decrease in plasma potential that serves to accelerate the ions. The electrons in the beam are again supplied by the continuous plasma from the discharge region.

Yet another means of accelerating ions in a quasi-neutral plasma is described in U.S. Pat. No. 4,862,032—Kaufman, et al. As described therein, a gradient in magnetic field can interact with electrons to generate an electric field in a plasma, and the electric field will accelerate ions.

In a gridded source, electrons are present in the plasma of the discharge region, but they are excluded from the acceleration region between grids. The ion acceleration in such a source is electrostatic, i.e., caused by the voltage difference between the grids. The beam from a gridded ion source must be a quasi-neutral plasma (to avoid the mutual repulsion of a beam consisting only of positively charged ions), so electrons are added after electrostatic acceleration by an electron-emitting neutralizer. Gridded sources have been almost always been called "ion sources," and that nomenclature is used herein. The means of extracting ions from a discharge plasma, accelerating them between electrically charged grids, and adding electrons to form a beam of quasi-neutral plasma are well understood by those skilled in the art and are described by Kaufman, et al., in the *AIAA Journal*, Vol. 20 (1982), beginning on page 745. It is also understood by those skilled in the art that, in the event of only grounded surfaces for the beam to impinge on, it is sometimes possible for the electrons added to the beam to come only from the secondary emission of ions striking grounded surfaces.

Beam nomenclature: If a source is called an "ion source," the beam from it is usually called an "ion beam," even though that beam satisfies quasi-neutrality and is a plasma. If a source is called a "plasma source," the beam is usually called a "plasma" or "plasma beam," although it has also sometimes been called an "ion beam." Herein it is called simply a "beam," which is defined as being comprised of energetic ions accompanied by sufficient electrons to make it a quasi-neutral plasma, regardless of whether the source is a plasma source or an ion source.

The particular sources described in the aforesaid article by Kaufman, et al., in the *AIAA Journal* use a direct-current discharge to generate ions. It is also possible to use electrostatic ion acceleration with a radio-frequency discharge, as described in U.S. Pat. No. 5,274,306—Kaufman, et al. for a capacitively coupled discharge, and U.S. Pat. No. 5,198,718—Davis, et al. for an inductively coupled discharge. These publications are incorporated herein by reference.

Plasma sources are described in the aforementioned U.S. Pat. No. 4,862,032—Kaufman, et al., and in the aforementioned article by Zhurin, et al., in *Plasma Sources Science & Technology*. The particular sources described in these publications use a direct-current discharge to generate ions. It is also possible for a gridless source to use a radio-frequency discharge, as described in U.S. Pat. No. 5,304,282—Flamm. These publications are also incorporated herein by reference. It should be noted that the aforesaid patent by Flamm uses the free expansion of a plasma for ion acceleration that was described previously.

The most common geometric configuration for either an ion (gridded) or plasma (gridless) source is one that generates a beam with a circular cross section. However, linear configurations, in which the cross section of the beam is greatly extended in one direction, have also been used. One such linear source is described by Wykoff, et al., in an article in *Proceedings of the Eighth International Conference on Vacuum Web Coating*, Las Vegas, Nev., Nov. 6-8, 1994, beginning on page 81. This publication is also incorporated herein by reference. In addition, beams with an annular cross section are described in the aforementioned article by Zhurin.

This patent is concerned with the generation of ions for a source, either ion or plasma, using an inductively coupled radio-frequency discharge. The beams from such sources have presented problems in that the distribution of energetic ions departed substantially from what was expected and/or needed. An ion source with a circular beam can be assumed to illustrate these problems. Such a source has a general axial symmetry and that symmetry would be expected to be reproduced in the beam. That is, while radial variations in ion current density might be expected, the beam would be expected to have symmetry about the axis of source symmetry. It is true that asymmetry can be introduced by such things as an asymmetric variation in spacing between ion-optics grids, but it is assumed that the design and construction of the ion source is carried out by those skilled in the art and the sources do not incorporate such obvious shortcomings.

To be more specific, the primary concern here is with those perturbations or departures from expectations associated with the inductor, comprised of multiple turns of high conductivity wire, that couples radio-frequency energy to the ion-generating discharge. There have been increasingly difficult requirements for precision in the control of beams from ion and plasma sources. At present, it is difficult to use the beams from these sources in many applications if the distributions of ion current density are not controlled to give reproducibility or beam symmetry within several percent. In some cases, that control results in a several-percent requirement for uniformity over most of the cross section of that beam.

SUMMARY OF INVENTION

In light of the foregoing, it is a general object of the invention to mitigate the variations of ion current density in the beam from an inductively coupled radio-frequency ion or plasma source that result from the terminations of the multiple-turn inductor that is used to generate ions in that source.

Another general object of the invention is to provide a modified radio-frequency inductor for an ion or plasma source that is simple to fabricate and use, while giving improved uniformity in the azimuthal direction (the angle around the axis) for a circular beam or in the long direction for a linear beam.

Yet another general object of the invention is to provide a modified radio-frequency inductor for an ion or plasma source that provides such improved uniformity, while requiring energy from only a single radio-frequency power supply.

Still another general object of the invention is to provide a modified radio-frequency inductor for an ion or plasma source that minimizes the radio-frequency power required to obtain such improved uniformity.

A specific object of the invention is to provide a modified radio-frequency inductor for an ion or plasma source that does not require a complicated and expensive discharge-chamber shape to obtain such uniformity.

Another specific object of the invention is to provide a modified radio-frequency inductor for an ion or plasma source that does not require the presence of an additional magnetic field in the discharge region to obtain such uniformity, said magnetic field being generated by either a stationary or moving permanent magnet.

Still another specific object of the invention is to provide a modified radio-frequency inductor for an ion or plasma source that does not require the presence of an additional magnetic field in the discharge region to obtain such uniformity, said magnetic field being generated by either a stationary or moving electromagnet.

A still further specific object of the invention is to mitigate the variations of ion current density in the beam from an inductively coupled radio-frequency ion or plasma source that result from the terminations of the inductor that is used to generate ions in that source without a variety of ad hoc modifications to that source.

In accordance with one embodiment of the present invention, the dielectric discharge chamber of a generally axially symmetric ion source has a hollow cylindrical shape. One end of the discharge chamber is closed with a dielectric wall. The working gas is introduced through an aperture in the center of this wall. The ion-optics grids are at the other end of the discharge chamber, which is left open. The inductor is a helical coil of copper conductor that surrounds the cylindrical portion of the dielectric discharge chamber. The modification that produces uniformity about the axis of symmetry is a shorted turn of the helical-coil inductor at the end of the inductor closest to the ion-optics grids.

DESCRIPTION OF FIGURES

Features of the present invention which are believed to be patentable are set forth with particularity in the appended claims. The organization and manner of operation of the invention, together with further objectives and advantages thereof, may be understood by reference to the following descriptions of specific embodiments thereof taken in connection with the accompanying drawings, in the several figures of which like reference numerals identify like elements and in which:

DESCRIPTION OF PRIOR ART

Figure 1:
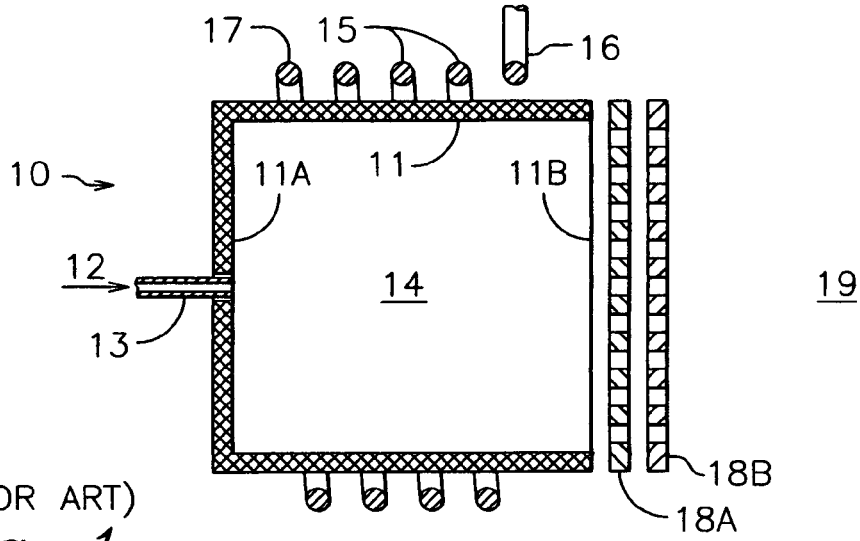
(PRIOR ART) Fig. 1
FIG. 1 shows the cross section of a prior-art ion source, in which the ions are generated by radio-frequency energy that is coupled to the discharge region within a discharge chamber with an inductor.

Referring to FIG. 1, there is shown prior-art ion source 10. This source has axially-symmetric dielectric discharge chamber 11, having closed end 11A and open end 11B. Ionizable working gas 12 is introduced through electrically isolated gas tube 13 into discharge region 14, which is enclosed by discharge chamber 11. Surrounding the discharge chamber is multiple-turn inductor 15, which has ends 16 and 17. At the open end of discharge chamber 11 are ion-optics grids 18A and 18B. Beyond the ion-optics grids is external volume 19.

The usual material choices are quartz or alumina for dielectric discharge chamber 11, copper wire or wire plated with copper or silver to at least the radio-frequency "skin depth" for inductor 15, and graphite or molybdenum for grids 18A and 18B.

In operation, a source of radio-frequency (rf) energy (not shown in FIG. 1) supplies a rf electrical current to ends 16 and 17 of inductor 15. The frequency of this rf energy is not critical and extends from several hundred kHz to tens of MHZ. This rf current generates a rf magnetic field in the generally axial direction in discharge region 14 enclosed by chamber 11 which, in turn, generates a rf azimuthal electric field (around the axis of the source) within that region. This rf azimuthal electric field energizes electrons within region 14, which strike molecules of ionizable gas within that volume and generate ions and additional electrons.

The mixture of electrons and ions forms a quasi-neutral, electrically-conductive gas called a plasma within region 14. This plasma is in contact with electrically conductive grid 18A and assumes a potential close to that of the grid, which is connected to the positive terminal of a first direct-current (dc) power supply (not shown in FIG. 1). Grid 18B is connected to the negative terminal of a second dc power supply (also not shown in FIG. 1). The negative terminal of the first dc power supply and the positive terminal of the second dc power supply are connected to ground, which is defined as the potential of the surrounding vacuum chamber in an industrial application and the potential of the space plasma far from a spacecraft in a space propulsion application. The potential of an industrial vacuum chamber is usually, but not always, at earth ground.

The ions that reach ion-optics grid 18A (usually called the screen grid) are formed into beamlets by the apertures in that grid. (A beamlet is the portion of an ion beam that passes through a single aperture of electrostatic ion optics.) These ions are accelerated by the electric field between grids 18A and 18B and, in normal operation, continue on to form a beam in external volume 19 to the right of grids 18A and 18B in FIG. 1. Electrons are added to this beam by a neutralizer (also not shown) so that the beam of ions and added electrons forms another quasi-neutral plasma near ground potential. The negative potential of grid 18B forms a barrier to prevent electrons from the beam plasma from flowing back through the grids to the positive-potential plasma in the discharge chamber. Additional grids have also been used in the ion optics, but the two grids shown in FIG. 1 are sufficient to illustrate the basic operation of almost all ion sources. The processes of extracting ions from a discharge plasma, accelerating them between electrically charged grids, and adding electrons to form a beam of quasi-neutral plasma are well understood by those skilled in the art and are described in the aforesaid article by Kaufman, et al., in the *AIAA Journal*. There is an exception to the use of two grids illustrating the operation of ion sources. The use of single-grid optics is an option at low ion energies (less than about 100 eV) and is described by Kaufman, et al., in an article in *J. of Vacuum Science and Technology*, Vol. 21, 1982, beginning on page 725. It should be clear from the preceding descriptions that a variety of electrostatic acceleration means is available for ion sources.

Inductor 15 is part of a resonant inductive-capacitive circuit. The resonant condition is necessary for the current in the conductor to be large enough to sustain a discharge that generates ions. To have a high "Q" (approximately the ratio of rf inductive or capacitive impedance to circuit resistance at resonance), the inductor must be made of a high conductivity material, usually copper. Other possibilities include, but are not limited to, silver and gold. As indicated previously, the high-conductivity material may be limited to a thin layer or plating, equal to or greater than the "skin thickness" at the frequency used.

It should be noted that, while the source shown in FIG. 1 is an ion source, grids 18A and 18B could be removed to leave a prior-art plasma source—see aforementioned U.S. Pat. No. 5,304,282—Flamm. The ion acceleration in that case would be due to the expansion of the plasma from a high density in discharge region 14 to a low density in external volume 19, as described previously in connection with Equation (1).

Still referring to FIG. 1, the means of introducing working gas 12 is through electrically isolated gas tube 13 which extends through an aperture in closed end 11A of discharge chamber 11. Alternatively, the introduction means for working gas 12 could have been through an aperture, or apertures, located elsewhere in discharge chamber 11. If the pressure in external volume 19 was sufficiently high, the introduction means could be through open end 11B.

Also in FIG. 1, the rf energy is coupled to discharge region 14 by having inductor 15 surround discharge chamber 11. This is a convenient means of coupling the rf energy because the largest rf magnetic field is centrally located on the axis of a generally cylindrically shaped inductor. However, other coupling means may be used. In the aforesaid U.S. Patent by Davis, et al., the inductor is generally in the form of a flat spiral close to the closed end of the discharge chamber. This configuration places much of the largest magnetic field outside of the discharge chamber. It also permits the side walls of the chamber (where the inductor is usually located) to be made of a metal instead of a dielectric. Although a reference is not given in the prior art of this specification, those skilled in the art will recognize that inductors have also been placed inside of discharge chambers. This location can result in overheating of the inductor, but it is effective in coupling the rf energy to the discharge region. A wide range of inductor locations can thus provide a coupling means to the discharge region, as long as the inductor is close enough that there is sufficient rf magnetic field to generate ions in the discharge region.

Figure 2:
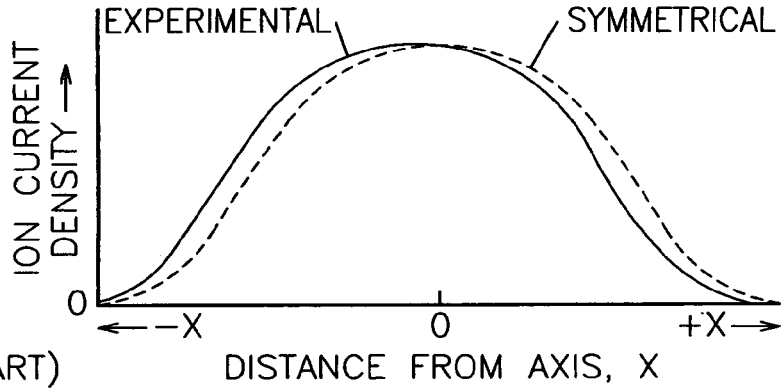
(PRIOR ART) Fig. 2
FIG. 2 shows a profile of ion current density in the beam from the prior-art ion source of FIG. 1.

Referring to FIG. 2, there is shown a typical profile of ion current density in the beam from prior-art ion source 10. The dashed-line profile is symmetrical about the axis of the ion source, and represents what is expected from an ion source that is generally axially symmetric in construction. What is found experimentally, however, is a substantial departure from symmetry, as shown by the solid-line profile. This departure from symmetry causes a variety of problems. If the beam is used for industrial processing, the rotational orientation of the ion source becomes important. If the source is used for space propulsion, the departure of the thrust axis from the source axis must be accommodated in the mechanical design of the spacecraft. Even the characterization of the beam is complicated by the need to survey over the entire beam instead of just over the radius.

It is also necessary to consider different types of symmetry for ion source 10 shown in FIG. 1. The preceding discussion assumes an ion source that is generally axially symmetric in geometry and uniformity is desired around the axis of symmetry. As described in the aforesaid article in the *Proceedings of the Eighth International Conference on Vacuum Web Coating*, sources can also be linear in configuration, where uniformity of the beam in the long direction of the source is usually desired. It should be evident that ion source 10 in FIG. 1 could be the cross section of a linear ion source, with the long direction of the source extending normal to the direction of the paper on which the figure is printed. The source could also be annular in shape, as described in the aforesaid article in *Plasma Sources Science & Technology*, and ion source 10 in FIG. 1 would represent the cross section of the annulus and the concern would be for uniformity around the annulus. Although the discussion of prior art is simplified by the focus on sources that are axially symmetric, a variety of other plasma and ion source configurations exists in the prior art and this variety is assumed to be included in this review of prior art.

Figure 3:
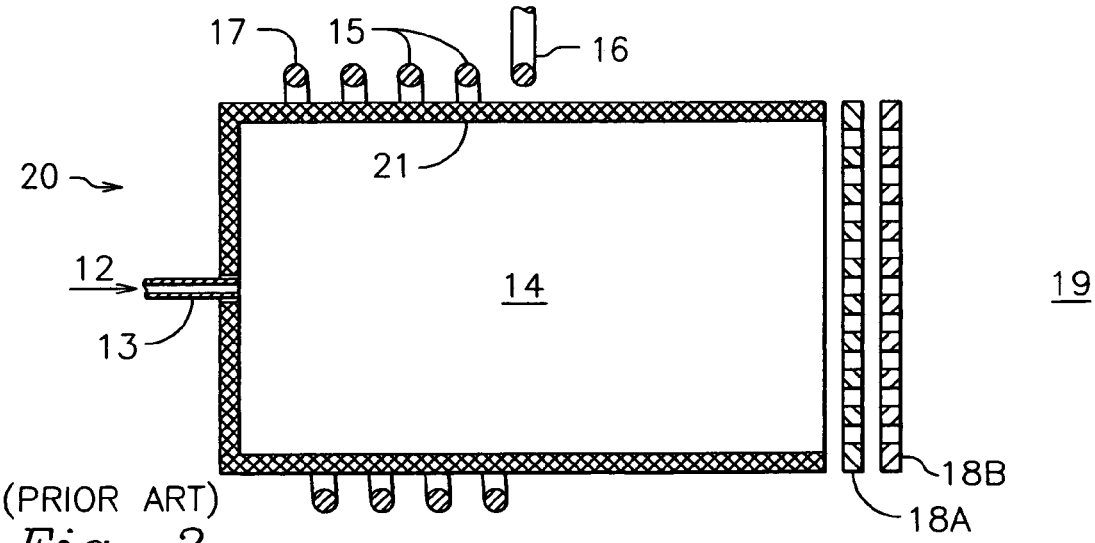
(PRIOR ART) Fig. 3
FIG. 3 shows the cross section of another prior-art ion source similar to that shown in FIG. 1, except that the inductor is at a greater distance from the open end of the discharge chamber.

Referring to FIG. 3, there is shown another prior-art ion source 20. Ion source 20 differs from ion source 10 in having dielectric discharge chamber 21 longer than dielectric discharge chamber 11 and in having inductor 15 with ends 16 and 17 farther from the open end of the discharge chamber. Experimentally, if the extended discharge chamber is long enough, the plasma leaving the open end is azimuthally uniform, i.e., uniform around the axis of the source. But most of the ions generated in discharge region 14 are generated near the inductor and are likely to be collected by the extended walls of the discharge chamber before reaching grids 18A and 18B. As a result of this collection, the rf power to generate a useful extracted ion current becomes excessive. The configuration shown in FIG. 3 is common in physics experiments where only a small ion current is required and efficiency is not important. For an example, see U.S. Pat. No. 3,958,883—Turner.

Figure 4:
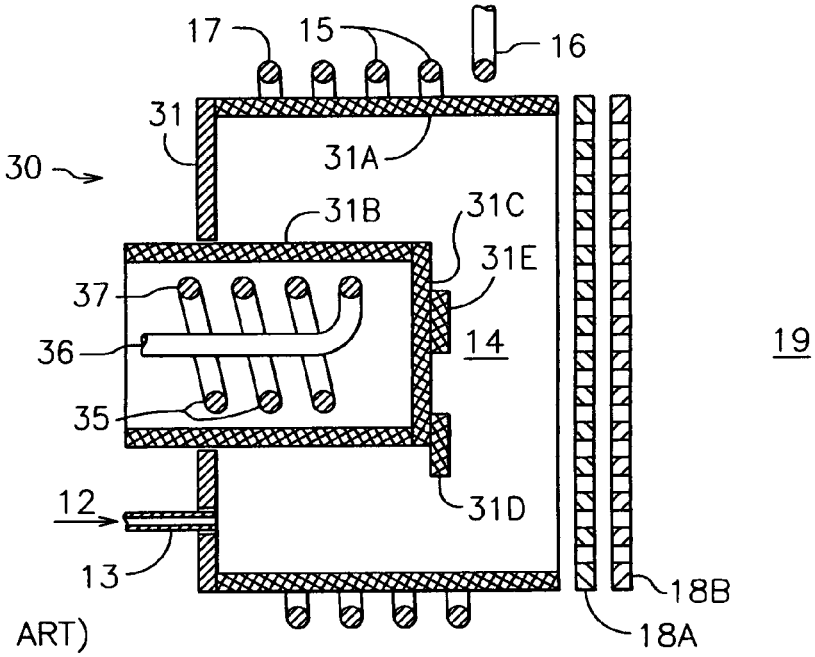
(PRIOR ART) Fig. 4
FIG. 4 shows a cross section of another prior-art ion source with a re-entrant discharge-chamber shape and an additional radio-frequency inductor.

Referring to FIG. 4, there is shown yet another prior-art ion source 30. This source also has a generally axially symmetric geometry. Further details of this ion source can be found in U.S. Pat. No. 7,183,716—Kanarov, et al. It should be kept in mind that the objective in the patent by Kanarov, et al., is uniformity of ion current density over much of the beam, and not just avoiding asymmetry about the source axis.

There are several features that are of interest in ion source 30. The first of these features is re-entrant dielectric discharge chamber 31A, 31B, and 31C, with extensions 31D and 31E. Back wall 31 of the discharge chamber is not necessarily made of a dielectric material. It is stated in the aforesaid patent that the relative dimensions of the re-entrant discharge chamber and the sizes and locations of extensions 31D and 31E can be optimized for beam uniformity. It is recognized in the aforesaid patent that the ion current density, $j_i$, in a beam from a nominally axially symmetric source is not axially symmetric, but is a function of both radius, r, from the axis of that source and the azimuthal angle, $\phi$, about that axis, $$j_i = f(r,\phi). \tag{2}$$

The approach used therein is to treat radial and azimuthal features in no particular order or priority. For example, re-entrant cavity 31B and 31C addresses radial variations, and extensions 31D and 31E on that cavity address both radial and azimuthal variations, but no relative priority is given in their use.

Figure 5:
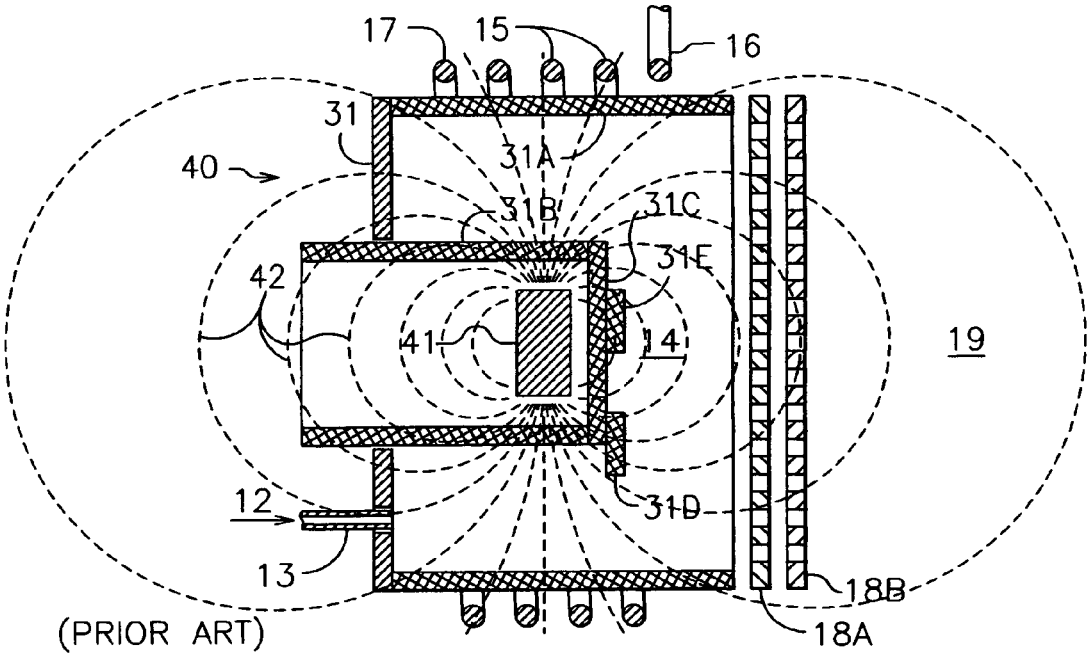
(PRIOR ART) Fig. 5
FIG. 5 shows a cross section of yet another prior-art ion source with a re-entrant discharge-chamber shape and a permanent magnet within the center cavity.

Other features described in the aforesaid patent include additional inductor 35 with ends 36 and 37, and, in ion source 40 and FIG. 5, permanent magnet 41, either stationary or moving. Other ways of reducing departures from a uniform beam include changing the thickness of, or hole diameters in, the screen grid (grid 18A). Examples of other variations in grid and ion-optics parameters, although for a different purpose, are given in U.S. Pat. No. 3,311,772—Speiser, et al. The additional feature of a complicated electromagnet in the re-entrant cavity is shown in U.S. Pat. No. 7,557,362—Yevtukhov, et al.

To summarize the prior art, nominally axially symmetric ion and plasma sources that use inductively coupled radio-frequency energy have variations of ion current density in their beams. These variations include both radial and azimuthal components. A variety of techniques has been used to make these beams more uniform. As mentioned previously, ion and plasma sources with shapes other than axially symmetric have also been used, and similar techniques could be used to produce uniform beams from such sources. For example, a primary concern for a linear source is usually the generation of a beam that does not vary significantly in ion current density along the length of the plasma source. An elongated re-entrant chamber could be used to this end, together with extensions on the re-entrant chamber contoured to produce the desired uniformity.

DESCRIPTION OF PREFERRED EMBODIMENT

Figure 6:
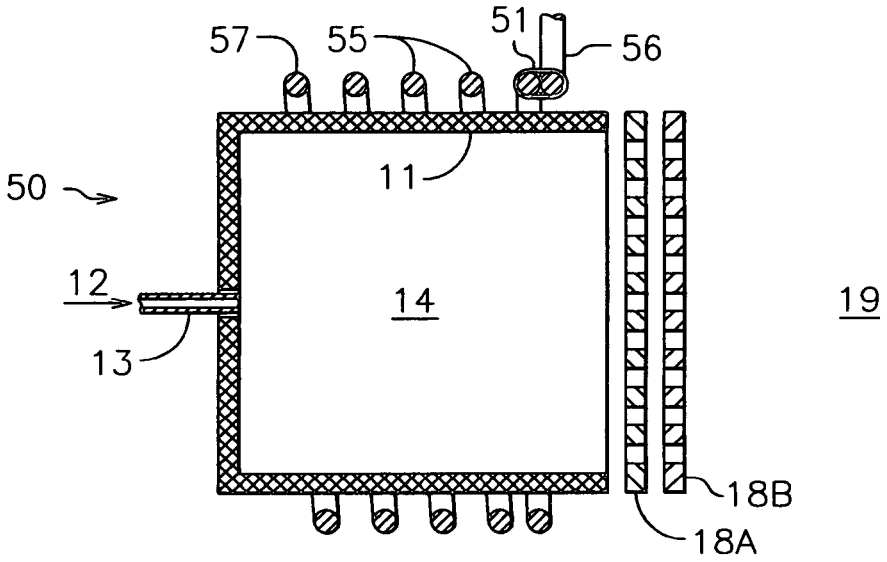
FIG. 6 shows a cross section of an ion source that incorporates an embodiment of the present invention.

Referring to FIG. 6, there is shown an embodiment of the present invention. Ion source 50 is similar to ion source 10 in FIG. 1 in configuration, except that inductor 15 with ends 16 and 17 is replaced with inductor 55 which has ends 56 and 57, but with the termination at end 56 comprised of one turn, shorted to itself by connector 51. The shorted turn can be considered as a turn at one end of inductor 55, shorted to itself or, alternatively, a shorted turn in electrical contact at one or more locations with the turn at one end of inductor 55. The operation of source 50 is also generally similar to that of source 10. However, a significant difference in operation is found in the profile of ion current density.

Figure 7:
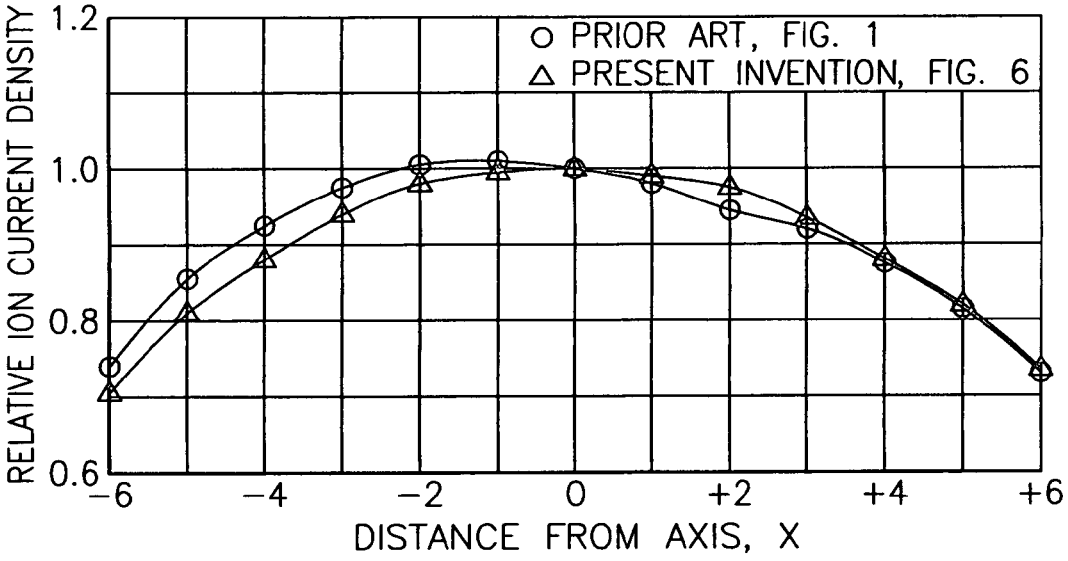
FIG. 7 shows the profiles of ion current density in the beam from a 14-cm ion source, taken 2 cm from the source, with the source constructed in accord with prior-art FIG. 1 and then modified to be in accord with present invention FIG. 6.

Referring to FIG. 7, there are shown the profiles of an inductively coupled rf ion source both with (FIG. 6) and without (FIG. 1) a shorted turn at the end of the inductor. The gridded ion source used had a beam diameter of 14 cm. The apertures in the grids were 2 mm in diameter with the apertures arranged in a hexagonal array having a center-to-center spacing of 2.5 mm. This array of holes was limited to those holes having centers within a diameter of 14 cm. The inductor had 10 turns of copper wire, a mean coil diameter of 18.3 cm, and ended about 2 cm from the ion optics (grids 18A and 18B). The potential of grid 18A relative to vacuum-chamber ground was +500 V and that of grid 18B was −75V, while the total ion current through the ion optics was 225 mA. The working gas was argon and the frequency of the rf power supply was about 2 MHZ.

The beam was surveyed with a screened probe at a distance of about 2 cm from the ion optics. (A screened probe is described by Kahn, et al., in an article in the 48*th Annual Technical Conference Proceedings of the Society of Vacuum Coaters,* 2005, beginning on page 17, 2005.) Surveys were made through the axis from different directions to find the maximum departure from axial symmetry. For this maximum-departure direction and 3 and 4 cm radii, approximately midway between the axis and the maximum 7 cm radius of the ion optics, the ion current density varied ±2.6% and ±2.5% from the mean values at these radii when no shorted turn was used at the ion-optics end of the inductor. With a shorted turn at the end of the inductor, the variation at 3 and 4 cm radii dropped to ±0.1% and ±0.2% from the mean values at these radii.

The effectiveness of the shorted turn in reducing departures from axial symmetry is striking and the explanation of this effectiveness is not obvious from prior art. The aforesaid U.S. Patents by Kanarov, et al., and Yevtukhov, et al. indicate a variety of techniques can be used for achieving a uniform ion current density, but they give no priority in mitigating the radial and azimuthal variations and tend to treat the two at the same time. (See for example, the use of extensions 112a and 112b in FIG. 1 of Kanarov, et al.)

From a more fundamental technical viewpoint, if the cause of particular problem is understood, it can often be compensated for, or corrected, or mitigated at or near the source of the problem. This usually results in a more global solution than using a variety of compensations or corrections at a distance from the source of the problem which, in turn, can often require further compensations or corrections at still further locations.

Asymmetric operation of an ion source is normally the result of an asymmetry in the apparatus. If a source that is nominally axially symmetric is examined closely, it is apparent that there is very little departure from axial symmetry in that source. Departures from axial symmetry in the ion optics were mentioned previously, but it was also mentioned that such departures are understood by those skilled in the art and need not be a cause of asymmetry in operation. If the ion optics are ruled out, the most significant departure from axial symmetry is in the rf inductor, because it has a finite number of turns and the beginning and ending of the inductor constitute asymmetries.

The number of turns used in the inductors of rf ion and plasma sources typically ranges from several up to perhaps a dozen. A departure from symmetry would therefore be expected for the rf magnetic field near the end of an inductor. The local departure of that field, compared to the circumferentially averaged value near that location, would be expected to have a magnitude of the order of 1/N, where N is the number of turns in the inductor. The use of a shorted turn proximate to the end of an inductor and approximately following the contour of a turn near the end of that inductor appears from FIG. 7 to suppress the departure from symmetry where it originates, producing a substantially global mitigation of asymmetry in the beam.

The mechanism for the suppression of the departure from axial symmetry is Lenz's law. The induced voltage around a closed path (equal to the integral of the electric field over the path length) is proportional to the variation with time of the magnetic flux Φ passing through that closed path, $$\int E \cdot d1 \propto d\Phi/dt. \quad (3)$$

When the closed path follows a closed circuit of a material with a high electrical conductivity, the induced voltage around this closed path is approximately zero and, $$d\Phi/dt \approx 0. \quad (4)$$

Note that Equation (4) does not imply that $$d\phi/dA \approx 0 \quad (5)$$

everywhere within the shorted circuit. It is still possible for a positive value of flux density, dΦ/dA, at one location within the shorted circuit to be balanced by a negative value elsewhere. Nevertheless, the experimental effect of a shorted circuit of inductor as shown in FIG. 7 is clearly to reduce the overall beam asymmetry, along with reducing the total enclosed time-varying magnetic flux according to Equation (4).

It may be noted that there are usually closed circuits of metallic conductors in or near the ion optics of an ion source. The most common metallic material used for plasma or ion sources, however, is nonmagnetic stainless steel, with a resistivity approximately 50 times that of copper. (The resistivity of copper is about 1.7 micro-ohm-cm, while that of 304 stainless steel is about 90 micro-ohm-cm.) The effectiveness of stainless steel for forming closed circuits of conductor near an inductor is thus negligible compared to copper or another high-conductivity material.

Uniform Ion Current Density

The preceding discussion has focused on the generation of an axially symmetric beam, i.e., one with an axially symmetric distribution of ion current density. Here the focus is on generating a beam that is also uniform over a significant area. The ion source configuration used to produce the profile shown by triangular symbols in FIG. 7 is modified to also produce a uniform profile. The implied assumption here is that the problem of azimuthal variations is resolved by using the preferred embodiment of FIG. 6, and the radial variation can be corrected separately and independently of the azimuthal vatiation.

Mathematically, this is equivalent to assuming that the variables in the function on the right side of Equation (2) can be separated, $$f(r,\phi)=f(r)\cdot f(\phi). \quad (6)$$

In FIGS. 6 and 7 herein, the function f(ϕ) is addressed independently of the function f(r). Having corrected for the function f(ϕ) with the shorted turn in FIG. 6, a correction for the function f(r) is now made. Further, being a function only of r, only radial variations in apparatus should be required for this additional correction.

The radial correction in the apparatus was made by varying the diameters of the holes in screen grid 18A. The same 14-cm ion source used to generate the symmetric profile (triangles) in FIG. 7 was used for this correction. The same hole pattern was used with the same 2.5 mm center-to-center spacing. Inasmuch as the 2.0-mm hole size used previously was near the maximum possible with the 2.5-mm center-to-center spacing, the only practical variation in hole diameter was to decrease hole diameters near the center where the ion current density was the highest.

Figure 8:
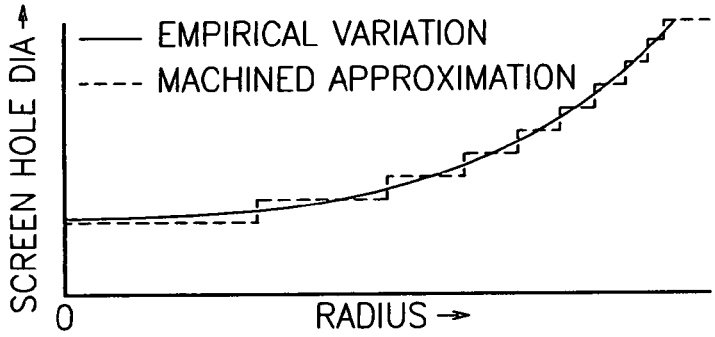
FIG. 8 shows how a radial variation in screen-grid hole diameter is used to correct for a radial variation in ion current density.

A procedure gives the desired variation in screen hole diameters. Several screens are made with different screen hole diameters. Ion-beam profiles are then obtained using those screens, while operating the ion source at the same beam voltage, accelerator voltage, rf power, and working-gas flow rate. The desired screen-hole diameter at each radius can then be found by interpolating between the profiles to obtain the desired current density. In this manner, different hole diameters are obtained at different radii, and are plotted as the "empirical variation" in FIG. 8. To reduce the number of drill diameters to a practical number, the same drill size is used over a range of radius, as shown be the "machined approximation" dashed line in FIG. 8. The optimum number of drill sizes and radial regions will depend on the uniformity requirements and the source-target distance. (The larger the source-target distance, the more local variations at the ion optics will be smoothed out at the target.)

Figure 9:
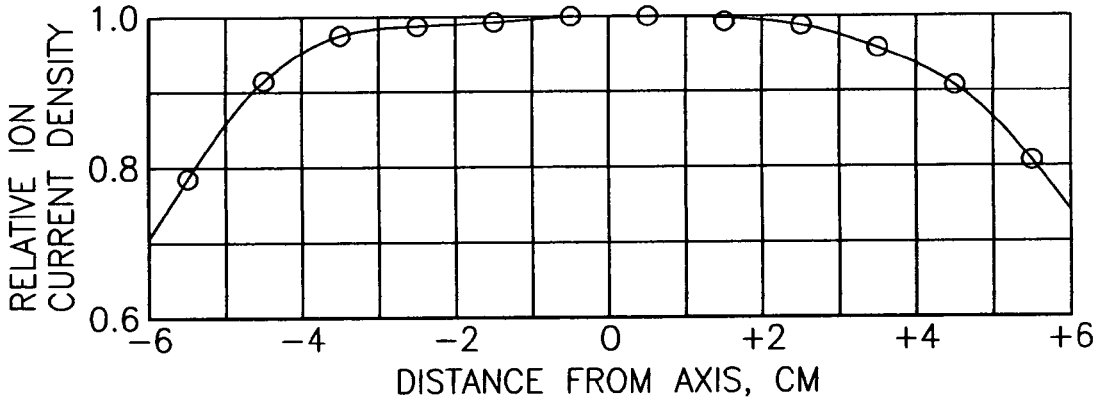
FIG. 9 shows the profile of ion current density in the beam, taken 25 cm from the same ion source that was used to generate the present-invention profile shown in FIG. 7, using a radial variation in screen-grid hole diameter similar to that indicated in FIG. 8.

Using the method of varying screen hole diameters described above in connection with FIG. 8, a screen grid was constructed for the 14-cm ion source used for the data shown in FIG. 7. The profile of ion current density was obtained with the 14-cm source at a distance of 25 cm from the source and is shown in FIG. 9. Several features of this profile are evident. One is that a very uniform ion current density is obtained in the center of the beam, ±2.1% over the center 7-cm diameter. An even more uniform beam is possible over a smaller diameter. The 7-cm diameter is substantially smaller than the 14-cm diameter at the ion-optics grids, but this is the result of the 25-cm distance from the ion source where the profile was obtained, as well as the inability to use screen-hole diameters larger than 2.0 mm near the edge of the screen grid. (If the effect of distance from the source is not clear, FIG. 11 in the aforesaid patent by Kanarov, et al., should be reviewed, together with the discussion related to that figure.)

Another conclusion that can be drawn from the profile in FIG. 9 is that, within reasonable experimental accuracy, corrections for azimuthal and radial variations can be carried out independently. This is the experimental equivalent of the theoretical separation of variables shown in Equation (6). This approach is much simpler than the ad hoc approach of Kanarov, et al. and Yevtukhov, et al., which requires a local correction for each local variation involving both $\phi$ and r.

The screen-hole diameter was selected as the variable to offset the radial variation in ion current density after the asymmetry in the beam was corrected with a shorted turn at the end of the inductor. The aforesaid patent by Speiser teaches that screen-hole diameter, grid spacing, and hole locations may all be varied. The aforesaid patent by Kanarov teaches that screen grid thickness may also be varied. Although the screen grid parameters would be expected to have more effect on the extraction of ions in the discharge region, accelerator grid parameters would also be expected to have some effect. The shape of the grids (e.g., dished as described by Kaufman, et al., in an article in the *Journal of Vacuum Science and Technology*, Vol. 16, beginning on page 899) could also be used to correct a radial variation in ion current density. These examples should show that a wide range of ion-optics parameters may be used to offset a variation in the radial direction of an ion source.

Alternate Embodiments

Figure 10:
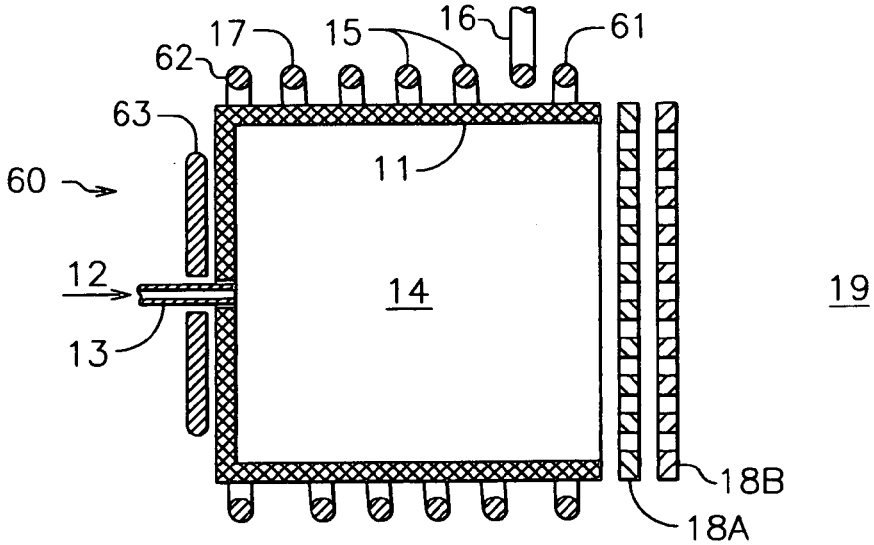
FIG. 10 shows a cross section of an ion source that incorporates alternate embodiments of the present invention.

Referring to FIG. 10, there is shown another embodiment of the present invention. Ion source 60 is again similar to ion source 10 in FIG. 1 in configuration, even including inductor 15 with ends 16 and 17, except that closed circuits of conductors 61, 62, and 63 are added near to, but separate from, inductor 15. That is, closed circuits 61, 62, and 63 are not in electrical contact with inductor 15. The operation of source 60 is also generally similar to that of source 10. Closed circuit 61 is close to inductor 15, and should mitigate the effects of inductor termination (end 16) similar to the use of a shorted turn at the end of inductor 55 in FIG. 6. Circuit 62 would be expected to mitigate the inductor-termination effects at the other end of inductor 15, hence have less effect on the uniformity near the ion optics than circuit 61, but perhaps still be useful when extreme uniformity is required. Circuit 63 is, except for a small aperture for admitting the working gas, a solid plate. For such a plate, Equation (4) does imply that Equation (5) is everywhere true within the plate. Closed circuits 61, 62, and 63 are exemplary of possible alternate embodiments, either individually or in any combination.

Prior art was presented that showed source and inductor configurations other than approximately axially symmetric are well known. A linear beam shape is described by Wykoff, et al., in the aforesaid article in the *Proceedings of the Eighth International Conference on Vacuum Web Coating*. An annular beam shape is described by Zhurin, et al., in the aforesaid article in *Plasma Sources Science & Technology*. Irregular beam shapes for specific applications are a further possibility.

Figure 11:
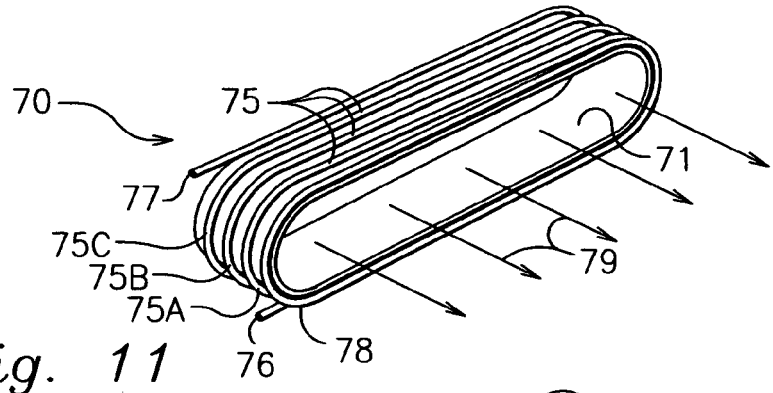
FIG. 11 shows a linear plasma source incorporating an embodiment of the present invention.

As example of a plasma inductor with a non-cylindrical shape that uses a closed circuit mitigation of the inductor termination, see FIG. 11. ("Plasma inductor" is defined here as an inductor used to generate a plasma, as in the discharge region of an inductively coupled rf ion or plasma source.) There is shown a linear plasma source. A screen grid and an accelerator grid could be added to make it an ion source, but the inductor, its closed-circuit mitigation, and the discharge chamber are more visible with the omission of the grids. In FIG. 11, linear rf plasma source 70 has inductor 75 which has ends 76 and 77. Closed circuit 78 follows the shape of inductor 75 near inductor end 76. The inductor encloses discharge chamber 71 and the general direction of the beam is indicated by arrows 79. To be more specific, inductor 75 has turns 75A, 75B, and 75C. To mitigate the termination of turn 75A, closed circuit 78 should approximate the shape of turn 75A, the turn closest to end 76. The selection of the particular turn used for approximating the shape of closed circuit 78 is not important for inductor 75, inasmuch as turns 75A, 75B, and 75C, are all similar in shape. The selection would be more important if the shape of the turns varied along the inductor, such as the in the inductor used in the aforesaid patent by Davis, et al.

The operation of plasma source 70 is similar to ion source 60 in FIG. 10, except that the ion acceleration is by the free expansion of plasma instead of electrostatically. The means of introducing a working gas is not visible in FIG. 11, but is similar to that in ion source 60. The mitigation of the inductor termination shown in FIG. 11 could be changed to that used in FIG. 6 by electrically connecting inductor 75 to closed circuit 78 at or near end 76.

Figure 12:
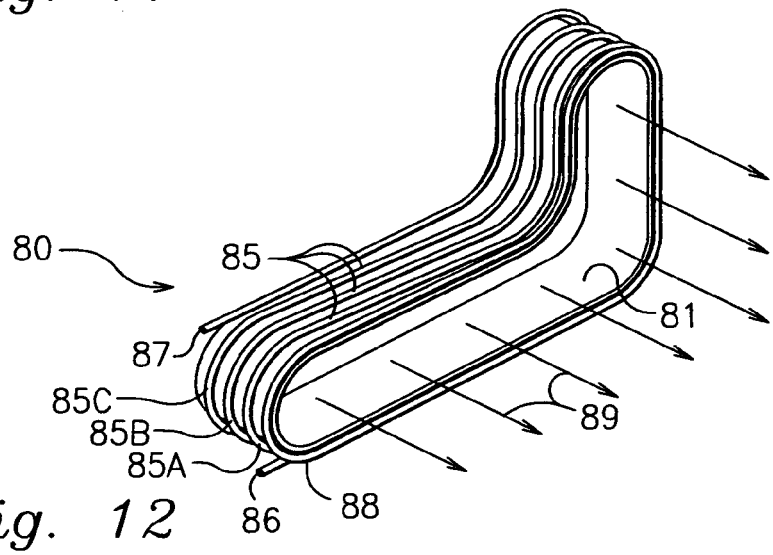
FIG. 12 shows an irregular plasma source incorporating an embodiment of the present invention.

Referring to FIG. 12, there is shown plasma source 80, with inductor 85 having turns 85A, 85B, and 85C, as well as ends 86 and 87. Inductor 85 surrounds discharge chamber 81. Closed circuit 88 is proximate to end 86 and similar in shape to turn 85A. Source 80 and its operation is similar to source 70 and its operation. The beam from source 80 has a shape similar to that source and the general direction of the beam is indicated by arrows 89. The important difference in plasma source 80, compared to source 70, is in the shape of the source and the corresponding shape of the beam. Source 80 and beam 89 is of an irregular shape without any axis or plane of symmetry. Source 80 can still benefit from this invention by mitigating or eliminating the disturbances in the discharge plasma and the beam leaving the source that result from the finite number of turns in the inductor and the terminations (ends) of that inductor.

For a more general approach, the present invention should be presented in terminology that does not depend on the geometric configuration of the apparatus. To this end, the localized effect of an inductor termination or end should be offset, remedied, or mitigated by a closed circuit of high-conductivity material (copper, silver, gold, etc.) that follows the shape of the inductor of interest and is spatially located close to the last turn of the inductor having that end. Source 80 in FIG. 12 is an example consistent an approach that does not depend on the geometric configuration of the apparatus.

Figure 13:
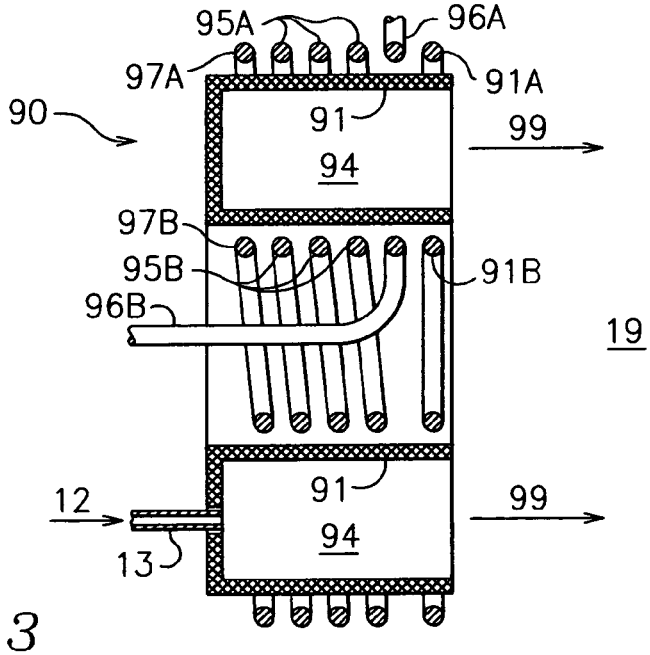
FIG. 13 shows an annular plasma source incorporating an embodiment of the present invention.

Referring to FIG. 13, there is shown annular plasma source 90. This source has annular discharge chamber 91. Ionizable working gas 12 is introduced through electrically isolated gas tube 13 to discharge region 94, which is enclosed by discharge chamber 91. Surrounding the discharge chamber is multiple-turn inductor 95A, which has ends 96A and 97A. Also surrounding discharge chamber 91, close to end 96A of inductor 95A, is closed circuit of conductor 91A. There is also multiple-turn inductor 95B, which has ends 96B and 97B, inside of the inner wall of discharge chamber 91. Also inside of this inner wall and close to end 96B of inductor 95B, is closed circuit of conductor 91B. To concentrate the rf magnetic field that generates the ions in discharge region 94, the rf currents in in inductors 95A and 95B are opposite in phase. Annular source 90 generates annular beam 99 in external volume 19. This alternate embodiment of the invention illustrates a topological variation. To operate correctly as an annular source, two inductors (95A and 95B) are required. To mitigate the terminations of these two inductors nearest beam 99 requires two closed circuits of conductor (91A and 91B).

The introduction of working gas in FIG. 13 is schematic only. Those skilled in the art will recognize that efficient operation of an annular ion or plasma source requires a more uniform azimuthal introduction of working gas to an annular discharge region than shown in FIG. 13.

As described in connection with FIG. 1, a variety of introduction means can be used for introducing the working gas to the discharge region. In a similar manner, a variety of inductor locations can be used as long as the inductor is close enough to the discharge region to couple the rf energy from the inductor and make ions in that region.

The rf transmission lines from the sources of radio-frequency (rf) energy to the inductors used in the generation of ions should also be mentioned. Depending on the frequency, the transmission line may consist of a coaxial cable or a closely spaced parallel pair of conductors. Properly designed, the transmission lines have little effect on the rf magnetic fields in the discharge regions of ion or plasma sources. For example, parallel conductors of a transmission line can frequently be spaced close enough to minimize the rf fields near the inductor while, at the same time, being far enough apart that negligible rf current is conducted through the capacitive coupling between the two conductors. However, the connections between the end of the transmission line and the ends of the inductor can contribute to the termination effects of an inductor. In the examples given herein, the connections from the transmission line to the inductor were assumed to be part of the inductor terminations and were not considered further.

While particular embodiments of the present invention have been shown and described, and various alternatives have been suggested, it will be obvious to those skilled in the art that changes and modifications may be made without departing from the invention in its broadest aspects. Therefore, the aim in the appended claims is to cover all such changes and modifications as fall within the true spirit and scope of that which is patentable.

We claim:

1. An ion source having a discharge chamber which has first and second ends and encloses a discharge region, wherein said first end is closed, and wherein said second end is open;

a means for introducing an ionizable gas into said discharge region;

a high-electrical-conductivity material of an inductor proximate said discharge region, said inductor having first and second ends through which a radio-frequency current is introduced, and said inductor also having a plurality of turns between said inductor ends;

a means for electrostatically accelerating ions that leave said open end of said discharge chamber into a beam of energetic ions;

a means for adding electrons to said beam of energetic ions; and a high-electrical-conductivity material of a closed circuit proximate said first end of said inductor and having a shape approximating only that of said turn of said inductor closest to said first end of said inductor; and wherein said high-electrical-conductivity material is continuous over said closed circuit and is not connected to a power source.

2. The ion source as defined in claim 1 wherein said first end of said inductor is closer to said second end of said discharge chamber than said second end of said inductor.

3. The ion source as defined in claim 1 wherein said high-electrical-conductivity material of said closed circuit is in electrical contact with said turn of said plurality of turns of said inductor closest to said first end of said inductor at one or more locations.

4. The ion source as defined in claim 1 wherein said inductor is in the shape of a helix.

5. The ion source as defined in claim 1 wherein said high-electrical-conductivity material of said inductor is copper.

6. The ion source as defined in claim 1 wherein said high-electrical-conductivity material of said closed circuit is copper.

7. A plasma source having a discharge chamber which has first and second ends and encloses a discharge region, wherein said first end is closed, and wherein said second end is open;

a means for introducing an ionizable gas into said discharge region;

a high-electrical-conductivity material of an inductor proximate said discharge chamber, said inductor having first and second ends through which a radio-frequency current is introduced, and said inductor also having a plurality of turns between said inductor ends;

a means for accelerating ions that leave said open end of said discharge chamber into a beam of electrons and energetic ions; and a high-electrical-conductivity material of a closed circuit proximate said first end of said inductor and having a shape approximating only that of said turn of said inductor closest to said first end of said inductor; and wherein said high-electrical-conductivity material is continuous over said closed circuit and is not connected to a power source.

8. The plasma source as defined in claim 7 wherein said first end said inductor is closer to said second end of said discharge chamber than said second end of said inductor.

9. The plasma source as defined in claim 7 wherein said high-electrical-conductivity material of said closed circuit is in electrical contact with said turn of said plurality of turns of said inductor closest to said first end of said inductor at one or more locations.

10. The plasma source as defined in claim 7 wherein said inductor is in the shape of a helix.

11. The plasma source as defined in claim 7 wherein said high-electrical-conductivity material in said inductor is copper.

12. The plasma source as defined in claim 7 wherein said high-electrical-conductivity material of said closed circuit is copper.

13. A method for constructing an ion source, the method comprising the steps of:

(a) providing a discharge chamber which has first and second ends and encloses a discharge region, wherein said first end is closed, and wherein said second is open;

(b) providing a means for introducing an ionizable gas into said discharge region;

(c) providing a high-electrical-conductivity material of an inductor proximate said discharge chamber, said inductor having first and second ends through which a radio-frequency current is introduced, and said inductor also having a plurality of turns between said inductor ends;

(d) providing a means for electrostatically accelerating ions that leave said open end of said discharge chamber into a beam of energetic ions;

(e) providing a means for adding electrons to said beam of energetic ions; and (f) providing a high-electrical-conductivity material of a closed circuit proximate said first end of said inductor and having a shape approximating only that of said turn of said inductor closest to said first end of said inductor; and wherein said high-electrical-conductivity material is continuous over said closed circuit and is not connected to a power source.

14. The method in accordance with claim 13 wherein said first end of said inductor is closer to said second end of said discharge chamber than said second end of said inductor.

15. The method in accordance with claim 13 wherein said high-electrical-conductivity material of said closed circuit is in electrical contact with said turn of said plurality of turns of said inductor closest to said first end of said inductor at one or more locations.

16. The method in accordance with claim 13 wherein said inductor is in the shape of a helix.

17. The method in accordance with claim 13 wherein said high-electrical-conductivity material of said inductor is copper.

18. The method in accordance with claim 13 wherein second high-electrical-conductivity material of said closed circuit is copper.

19. A method for constructing a plasma source, the method comprising the steps of:

(a) providing a discharge chamber which has first and second ends and encloses a discharge region, wherein said first end is closed, and wherein said second end is open;

(b) providing a means for introducing an ionizable gas into said discharge region;

(c) providing a high-electrical-conductivity material of an inductor proximate said discharge chamber, said inductor having first and second ends through which a radio-frequency current is introduced, and said inductor also having a plurality of turns between said inductor ends;

(d) providing a means for accelerating ions that leave said open end of said discharge chamber into a beam of electrons and energetic ions; and (e) providing a high-electrical-conductivity material of a closed circuit proximate said first end of said inductor and having a shape approximating only that of said turn of said inductor closest to said first end of said inductor; and wherein said high-electrical-conductivity material is continuous over said closed circuit and is not connected to a power source.

20. The method in accordance with claim 19 wherein said first end of said inductor is closer to said second end of said discharge chamber than said second end of said inductor.

21. The method in accordance with claim 19 wherein said high-electrical-conductivity material of said closed circuit is in electrical contact with said turn of said plurality of turns of said inductor closest to said first end of said inductor at one or more locations.

22. The method in accordance with claim 19 wherein said inductor is in the shape of a helix.

23. The method in accordance with claim 19 wherein said high-electrical-conductivity material of said inductor is copper.

24. The method in accordance with claim 19 wherein said high-electrical-conductivity material of said closed circuit is copper.

* * * * *